United States Patent [19]

Yeh

[11] Patent Number: 4,515,685

[45] Date of Patent: May 7, 1985

[54] TREATMENT AND SEPARATION OF PETROLEUMS AND RELATED MATERIALS

[76] Inventor: George C. Yeh, 2 Smedley Dr., Newtown Square, Pa. 19073

[21] Appl. No.: 608,263

[22] Filed: May 8, 1984

Related U.S. Application Data

[63] Continuation of Ser. No. 399,853, Jul. 19, 1982, abandoned.

[51] Int. Cl.[3] ..... C10C 3/00; C10C 3/08

[52] U.S. Cl. ..... 208/309; 208/251 R

[58] Field of Search ..... 208/309, 251 R

[56] References Cited

U.S. PATENT DOCUMENTS

| | | | |
|---|---|---|---|
| 2,189,844 | 2/1940 | Starr | 208/309 |
| 2,793,168 | 5/1957 | Corneil et al. | 208/251 R |
| 2,853,426 | 9/1958 | Peet | 208/251 R |
| 2,895,902 | 7/1959 | Peet | 208/251 R |
| 3,380,912 | 4/1968 | Paterson | 208/251 R |
| 3,798,157 | 3/1974 | Manzanilla et al. | 208/309 |

*Primary Examiner*—Delbert E. Gantz
*Assistant Examiner*—Helane Myers
*Attorney, Agent, or Firm*—Howson and Howson

[57] ABSTRACT

Herein are disclosed a method and apparatus whereby all petroleums and/or related materials, including natural materials (such as, petroleum gas, crude oils, bitumens, crude oils from oil sands and oil shales, tars from sands, etc.), fraction or fractions derived from said natural materials, and refinery streams and products, are refined and separated to remove their asphaltic constituents (asphaltenes, resins, etc.) and/or nonhydrocarbon constituents (metals, heteroatoms, etc.), by contacting said petroleums and/or said related materials with added asphaltenes, precipitating said constituents together with said added asphaltenes, and then separating the mixture of the resultant precipitates and said added asphaltenes to recover an oil (and/or gas) having a reduced concentration of said constituents.

Said mixture can also be separated to remove its residual volatile constituents to produce asphalts; or it can be treated by a low molecular weight paraffinic solvent to recover asphaltenes, which would have numerous potential usages although they have not been available commerically.

18 Claims, 3 Drawing Figures

TREATMENT AND SEPARATION OF PETROLEUMS AND RELATED MATERIALS

This application is a continuation of application Ser. No. 399,853, filed July 19, 1982, abandoned.

BACKGROUND OF THE INVENTION

1. Field of the Invention

This invention relates to a process for refining and separating all petroleums and/or related materials, including natural materials (such as, petroleum gas, crude oils, bitumens, oils from oil-sands or oil-shales, tars from tar-sands, etc.), petroleum fraction or fractions derived from said natural materials, and refinery streams and products and, more particularly as concerned with a novel method for removing and separating asphaltic constituents and/or nonhydrocarbon constituents by contacting said petroleums and/or said related materials with added asphaltenes, precipitating said constituents together with said added asphaltenes, and recovering an oil (and/or gas) having a reduced concentration of said constituents. In various processes according to the method provided by the present invention, asphalt or asphaltenes can also be recovered.

2. Description of Prior Art

Feedstocks for cracking processes are now usually the residue or heavy distillate from a distillation sequence. However, as the occasion demands, whole crudes may also serve as the cracking feedstocks and, when this is the case, the crude must be desalted prior to the cracking process. Like still residue, heavy crude petroleums usually contain substantial amounts of asphaltic constituents, which are not only regarded as the coke-forming constituents in many thermal processes but also the source of carbon depositing on the catalyst for cracking process, thus limiting the service life of the catalyst and the capacity of the catalytic cracking unit. Crude oils contain appreciable amounts of organic nonhydrocarbon constituents, mainly sulfur-, nitrogen-, and oxygen-containing compounds, in smaller amounts, organometalic compounds in solution and inorganic salts in colloidal suspension with asphaltenes and resins. These constituents appear throughout the entire boiling range of the crude oil but do tend to concentrate mainly in the nonvolatile fractions, especially asphaltenes and resins. In minute amounts, these compounds can cause serious corrosion problems, catalyst deactivation, degrading of product quality, health hazard, etc.

In general, there is an approximate correlation between the content of the nonhydrocarbon constituents and the content of the asphaltic constituents of a petroleum stock—the higher the asphaltic constituents content, the higher the nonhydrocarbon constituents content. It is, therefore, often deemed necessary that the asphaltic constituents be removed from feedstocks for cracking and other refining processes.

There are a number of methods which are directed at upgrading feedstocks and separating petroleums and related materials by removal of the asphaltic constituents and the nonhydrocarbon constituents. These conventional methods and processes may be summarized as follows:

1. Flash distillation
2. Vacuum flashing
3. Viscosity breaking
4. Coking
5. Solvent treatment 6. Caustic treatment
7. Gas treatment
8. Oxidative treatment
9. Adsorbent treatment 10. Acid treatment
11. Precipitation with reactive metal salts, etc.

The solvent treatment method is most effective in removing the asphaltic constituents, however it has been subject to considerable economic and operational disadvantages as all other conventional methods have, which often require special equipment and/or severe operating conditions. Most of these conventional methods are not applicable to the treatment of crude petroleums because of the large volumes and the high treatment costs. Some of these methods produce wastes which require special handling, and pose serious disposal problems.

OBJECT OF THE INVENTION

In view of the above, a principal object of the present invention is to provide a novel method for simultaneously removing both the asphaltic constituents and the nonhydrocarbon constituents from petroleums and/or related materials, which avoids the difficulties normally associated with conventional methods. In particular, it is an object of this invention to provide a simple but effective method for economically refining and separating crude petroleums in large volumes.

Another primary object of the invention is to provide a novel method for refining petroleums and/or related materials and, at the same time, economically recovering asphaltenes, which have not been commercially produced to any significant extent due to the high recovery cost of the conventional methods. Asphaltenes have been known to have numerous important potential usages.

Other important objects of the present invention are: (1) to provide a novel method for refining petroleums and/or related materials, which employs only petroleum fractions and no foreign substances; (2) to provide a novel method for refining petroleums and/or related materials which can be carried out in conjunction with many conventional methods; (3) to provide a novel method for refining petroleums and/or related materials which has relatively small energy requirements; (4) to provide a novel method for refining petroleums and/or related materials which can be carried out without special, costly equipment or hazardous operating conditions; (5) to provide a novel method for refining petroleums and/or related materials which produces no waste stream; and (6) to provide a novel method for refining petroleums and/or related materials which can be easily applied to feedstocks having a wide range of chemical composition and of physical properties, without requiring the major modification of equipment and operating conditions.

SUMMARY OF THE INVENTION

In accordance with the present invention, a petroleum (or related material) is rapidly and effectively refined by the removal of the asphaltic constituents and the nonhydrocarbon constituents from the former by contacting same with added asphaltenes, preferably those derived from the same feedstock being treated, and then precipitating and separating said asphaltic constituents and said nonhydrocarbon constituents together with said added asphaltenes to recover the oil fractions remaining. Under the above conditions, it has been found by the present inventor that the asphaltenes added to the feedstock will attract and associate with the resins and other heavy aromatics which are contained in said stock, and thus breaking the equilibria existing among the asphaltic compounds and other heavy aromatic compounds. The breaking of said equilibria results in the precipitation of the asphaltic constituents and the nonhydrocarbon constituents. The precipitation is followed by the agglomeration between the added asphaltenes and the precipitating asphaltic constituents. The agglomerates, can be easily separated from the remaining oil fractions, which comprises a deasphalted oil (and/or gas) suited as feedstock for further refining operations. The precipitates separated can be further treated to recover asphalts and/or asphaltenes. The asphaltenes recovered can be partly recycled to the above contacting step. The contacting of a petroleum stock with added asphaltenes is normally carried out at temperatures not higher than the boiling point of said stock, and the precipitation of the asphaltic constituents is usually achieved at temperatures near the room temperature. Therefore, heat can be exchanged between the contacting apparatus and the precipitating (and separating) apparatus, in order to save heat. Furthermore, said precipitates can be treated by a paraffinic solvent to precipitate high-quality asphaltenes. The solvent used can be recovered easily for recycling. Therefore, the method requires no chemicals, but fractions derived from the feedstock.

Asphaltenes are the brown-to-black, pulverulent, amorphous materials that are derived by treatment of petroleums, residua, bitumenous materials, etc. with a light petroleum naphtha or solvent. Petroleum naphthas range widely from the ordinary paraffinic straight-run to the highly aromatic types. On the basis of the solubility in a variety of solvents, it has been possible to distinguish amoung the various constituents of petroleums and/or related materials as follows:

(1) Carboids—Insoluble in carbon disulfide, carbon tetrachloride, and low molecular weight paraffins.
(2) Carbenes—Soluble in carbon disulfide, but insoluble in both carbon tetrachloride and low molecular weight paraffins.
(3) Asphaltenes—Soluble in both carbon disulfide and carbon tetrachloride, but insoluble in low molecular weight paraffins.
(4) Maltenes—Soluble in carbon disulfide, carbon tetrachloride, and low molecular weight paraffins.

Most petroleums contain practically no carboids and carbenes, but residue from the cracking processes may contain 2% by weight or more. In the industry, the separation of crude petroleums and bitumens into two fractions, asphaltenes and maltenes, is conveniently brought about by means of low molecular weight paraffins, which are known to have selective solvency for hydrocarbons and simple low molecular weight hydrocarbon derivatives. Petroleum naphthas of highly aromatic types may dissolve asphaltenes partly, or completely at high temperatures, and are therefore not recommended for treating asphaltenes or diluting asphaltenes containing petroleum stocks in this invention, in order to preserve the original characteristics of the asphaltenes to be used for contacting. Pentanes, heptanes and hexanes are recommended for the above purpose. Especially, n-pentane is known to precipitate asphaltenes effectively without affecting their characteristics appreciably. This inventor has found that more asphaltenes can be precipitated from asphaltenes containing petroleums or related materials by using n-pentane as a diluent. However, it still takes ≧40 volumes of n-pentane to dilute one volume of a crude oil in order to precipitate as much as 90% by weight of the asphaltenes contained in said crude, by using 10% by weight of silica gel as the precipitant. The same crude oil can be contacted with the asphaltenes of the type identical to that contained in said crude oil, in the amount equal to one half of the residue (cut point: 600° F.), to precipitate nearly 100% of the asphaltenes contained in said oil without dilution by n-pentane.

It should be instructive to discuss further the effect of the addition of asphaltenes into petroleums or related materials. The hydrocarbons and their series in petroleums and related materials are related closely, and they differ from each other mainly in molecular weight and H/C ratio. The close relations of the various hydrocarbon series comprising the asphaltenes, resins, and oils give rise to much overlapping of fractions into neighboring series, both in molecular weight and H/C ratio, although there is a large hydrogen deficiency in the asphaltene hydrocarbons in which the pronounced heterostructure appears. Excluding carboids and carbenes which may be contained in crude petroleums only in negligible amounts, the asphaltenes are the final condensation product. High aromaticity is generally prevalent in the asphaltenes and in the series. Indeed, the degree of aromaticity is of particular importance when the resins associate with the asphaltene particles, just as the degree of paraffinity is important when the resins dissociate. The higher the aromaticity of resins and of oils the better the solvency for asphaltenes, and the solvent power of resins and of oils is one of the most important facts in understanding the behavior of the asphaltene/maltene interface, which characterize the colloidal nature of crude petroleums and bitumens. The same asphaltenes that disperse in solvent of high aromaticity may precipitate readily in a solvent of low aromaticity. Specifically, this inventor has found that the colloidal stability of a petroleum, or of bitumen, can be easily broken by changing the asphaltenes/resins ratio of said petroleum or of said bitumen, or changing the type of the asphaltenes or of the resins in same. The degree of peptization of the asphaltenes in a crude petroleum appears to be affected strongly by the aromaticity, the metal constituents and the heteroatomic constituents of the resins and the heavy aromatics in said crude. For resins of equal aromaticity, those having higher contents of metals and heteroatoms appear to have greater peptization power for asphaltenes. It appears that the resins associate with asphaltenes in the manner of an electron/donor-acceptor relation, and furthermore, certain structural similarities between the asphaltene molecules and the resin molecules in the same crude could be playing an important role in determining the colloidal behavior of said crude. This fact has been experimentally observed by the inventor by introducing asphaltenes obtained from one crude oil into another crude oil of a different origin, and observing the stability of the newly formed asphaltenes-oil dispersion system. In every instance, asphaltenes dispersed more readily in the crude oil from which they had been obtained. By increasing the amount of the asphaltenes added a point of immiscibility is reached in the crude, at which the precipitation of asphaltenes and resins begins to take place in the crude. This finding has led the inventor to believe that for a given petroleum at a given temperature, there is a asphaltenes/resins ratio at which the maximum amount of asphaltenes can be dispersed in said crude without precipitating out. This ratio may be defined as the "asphaltenes/resins solvation constant, or ratio", the knowledge of which is useful in determining the optimum amount of asphaltenes required in contacting and separating a given petroleum. Furthermore, asphaltenes having higher H/C ratios can disperse in oils easier than asphaltenes having low H/C ratios. As the asphaltenes/resins ratio decreases an addition of asphaltenes having high H/C ratios may induce the formation of a gel, but an addition of asphaltenes having low H/C ratios would tend to precipitate asphaltenes. Again, these facts can be explained in terms of the aromaticity of the asphaltenes and that of the maltenes in the petroleum.

Extensive experimental evidence obtained by this inventor indicates that asphaltenes in untreated crude petroleums exist as single entities which are peptized by the resin molecules and dispersed by the heavy aromatic molecules in the crude. Asphaltenes in bitumens appear to exist as clusters, and those in residua usually exist as large agglomerations. There is experimental evidence that in untreated crude petroleums, hydrogen bonding could be a preferential intermolecular force acting between the resin molecules and the asphalten molecules. This may explain why asphaltenes in crude petroleums are more difficult to separate than those in residua. Asphaltene molecules which have lost their peptizing resin molecules will easily form clusters or agglomerates when they contact, due to their polarizabilities. Since both the asphaltene molecules and the resin molecules are very large, their diffusion rates in petroleums would be extremely small or negligible. Therefore, the conditions of agitation and mixing in the contacting operation provided by the present invention are extremely important. The direct intimate contact between the resins and the asphaltenes is utmost important. Individual asphaltene molecules peptized by many resin molecules through hydrogen-bonding form micelles, whose structure is such that the bulk of the substances with the greater molecular weight and the most pronounced aromatic and polar nature are arranged closest to the center (asphaltene molecule). These substances are again surrounded by lighter constituents of less aromatic and polar nature until a gradual transition to the intermiceller phase (oil) is formed. The metallic constituents and the heteroatomic constituents appear to concentrate inside the micelle rather than outside. Therefore, the separation of the asphaltenes and the resins from petroleums and/or related materials is the key to the removal of the nonhydrocarbon constituents (metals and heteroatoms). The breaking of the equilibrium at the asphaltene/resin interface by exceeding the asphaltenes/resins solvation constant (or ratio) discussed above is the key to the simple and effective separation of petroleums and/or related materials, in accordance to the principle of the present invention.

In the following, the present invention will be discussed in detail by reference to the preferred, basic processes of the invention shown in the accompanying drawings FIGS. 1, 2, and 3, and by reference to the examples given in TABLES 1 and 2.

BRIEF DESCRIPTION OF THE DRAWINGS

The accompanying drawings illustrate the method and apparatus of the present invention.

DETAILED DESCRIPTION OF THE INVENTION

The invention now will be described in detail, by reference to the several specific embodiments shown in the accompanying drawings, and to the results of experimental runs.

Figure 1:
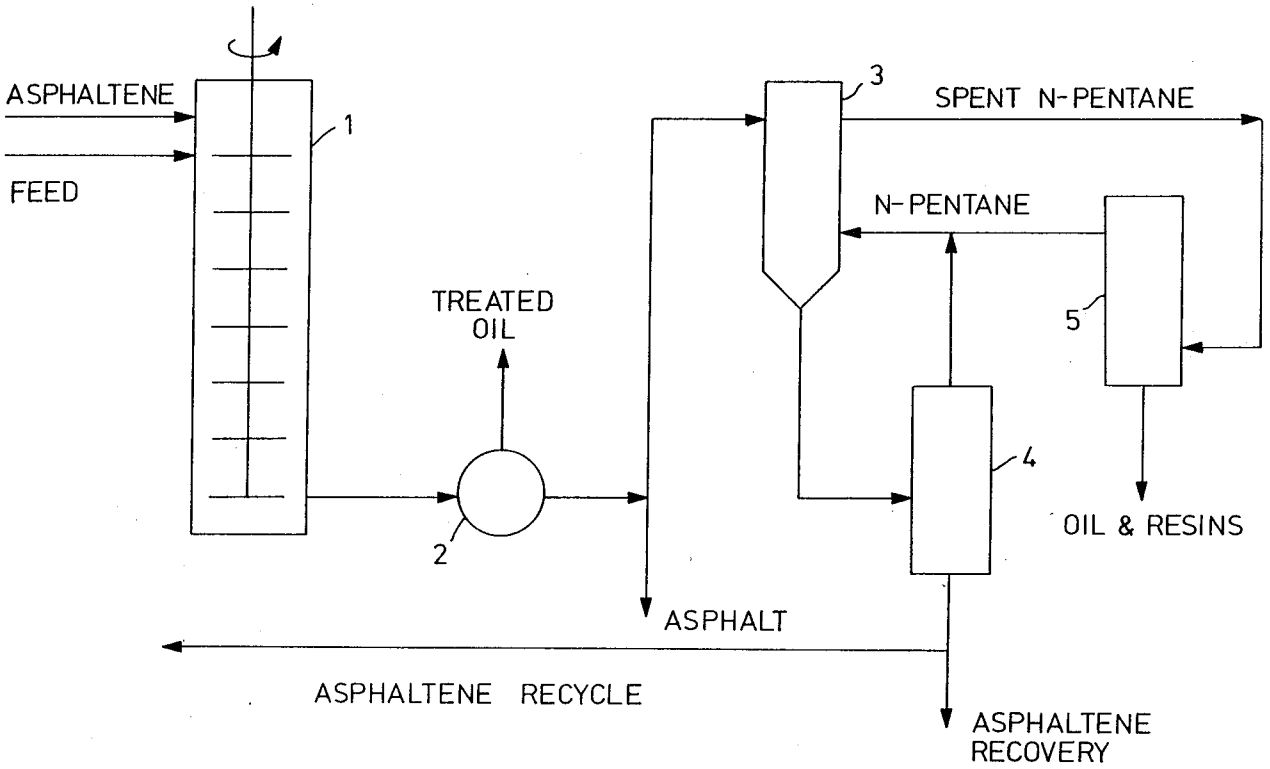
FIG. 1 is a schematic representation showing a preferred, basic process for refining and partially separating petroleums and related materials, in accordance with the method provided by the invention.

As noted above, FIG. 1 illustrates, in block diagram, a preferred basic process for refining and separating petroleums and related materials in accordance to the method provided by the invention, which comprises: (1) a contacting step, (2) a solid-liquid separating step, (3) an asphaltenes precipitation step, (4) an asphaltenes drying step, and (5) a n-pentane recovering step. Referring to FIG. 1, the contacting apparatus 1 may be a mixing tank, a fluidized-bed, etc. to provide the intimate contacting between the feedstock and the added asphaltenes and to facilitate the precipitation of the asphaltic constituents and the nonhydrocarbon constituents, together with said added asphaltenes; the solid-liquid separation apparatus 2 may be a filter, a centrifuge, a liquid-cyclone, etc. to effect the separation between the resultant precipitates and the oil constituents remaining; the ashaltene precipitating apparatus 3 may be a mixer-settler combination, a filter-bed, etc. to effect the dilution of said precipitants with n-pentane and the precipitation and the subsequent separation of asphaltenes from said n-pentane; the asphaltene drying apparatus 4 may be a flash drum, a vacuum drier, etc to remove the residual n-pentane from the precipitated asphaltenes for final recovery of asphaltenes: and the n-pentane recovery apparatus 5 may be a flash still, an evaporator, etc. to recover the n-pentane for recycling and the resins-oil mixture for further processing. The contacting step 1 and the solid-liquid separation step 2 are the basic steps, which can be carried out, if desirable, in a single apparatus, such as a counter-current mixer-settler, a contact filter, a rotary filter using asphaltenes as the filter-aid, etc. In the contacting apparatus 1, the feedstock is brought into intimate contact with an added asphaltenes to effect the precipitation of the asphaltic constituents and the nonhydrocarbon constituents together with said added asphaltenes, and in the solid-liquid separating apparatus 2, the mixture of solid masses precipitated is effectively separated from the liquid (oil) medium constituting the treated oil, which is suited as a feedstock for catalytic cracking and for many further refining operations. A part or whole, of said mixture can be flashed to remove the residual volatile constituents and then stripped with steam to produce high-quality asphalts. Said mixture of solid masses precipitated is treated with n-pentane in the asphaltane precipitation apparatus 3 to precipitate the asphaltenes, which are substantially free of resins. While the precipitated asphaltenes are dried in the asphaltene drying apparatus 4 for removal of the residual n-pentane, the spent n-pentane separated from the asphaltenes is sent to the n-pentane recovery unit 5 for recovery and recycling. A part of the asphaltenes recovered is recycled to the contacting apparatus 1. The resins-oil mixture from the n-pentane recovery unit 5 may be used as a feedstock for thermal cracking or for resin recovery.

The method and apparatus for the contacting may vary widely, as noted above. The contacting apparatus 1 in FIG. 1 should be, in general, equipped with a means for agitating and mixing the masses in said apparatus. Said means may include stirrer, aerator, vibrator, solid-state mixer, sonic generator, etc. The contacting apparatus 1 may be a fluidized-bed of added asphaltenes and the petroleum being treated. When a filter-bed (or packed-bed) is used to carry out both the contacting and the subsequent solid-liquid separation in the same apparatus, the periodic discharging of the resultant precipitants accumulated will be necessary. However, a continuous filter using asphaltenes as the filter-aid can be employed to effect the continuous contacting and separating of feedstocks. In this case, a layer of the precipitates retained on the filter-cloth will function like a filter-bed to effect the contacting, the precipitation, and the separation. The continuous contacting combined with the continuous solid-liquid separation can be as effective, if the fresh asphaltenes are continuously added to the feedstream.

Other solid-liquid contacting methods and apparatus, and various flow arrangements (counter-current, co-current, cross-current, etc.) also can be employed, as may be obvious to those who are skilled in the art. Needless to say, there are numerous different methods and apparatus for solid-liquid separation which can be employed in the practice of this invention.

Figure 2:
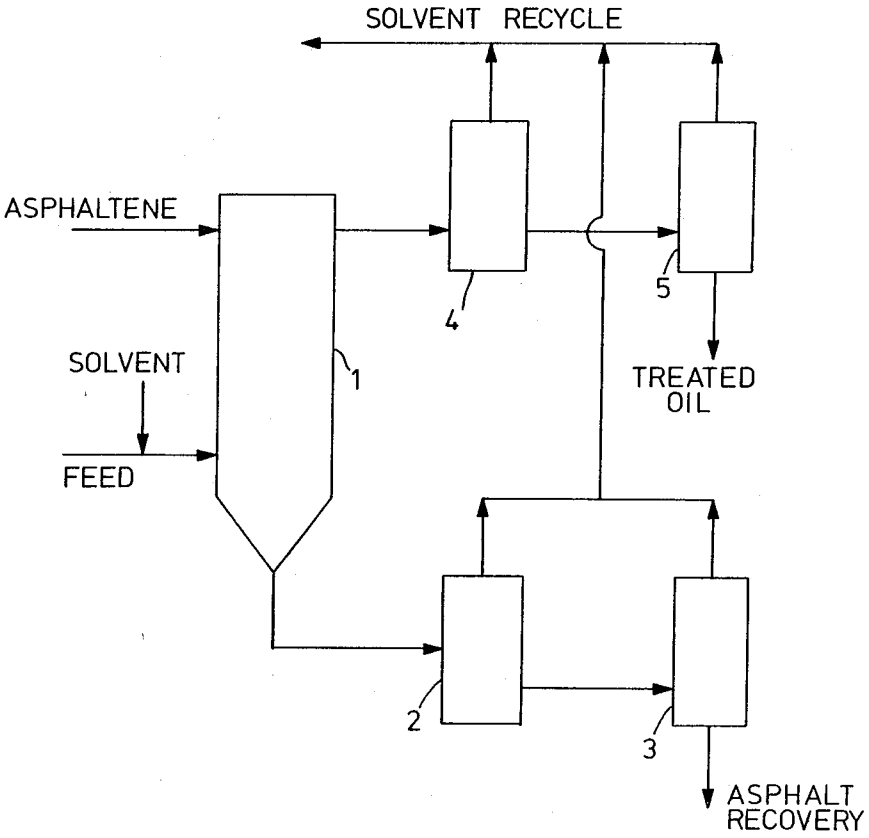
FIG. 2 is a schematic representation of a preferred, basic process for refining and partially separating heavy crude petroleums, bitumens, residua, etc. in accordance to the method provided by the invention.

As noted above, FIG. 2 is a schematic representation of a preferred basic process for refining and separating heavy crude pretroleums, bitumens, residua, etc., in accordance with the method provided by the invention; said process including the recovery of the solvent and the asphalt. Referring to FIG. 2, feedstocks are diluted by a petroleum fraction (or fractions) having a boiling range not exceeding 600° F., preferably, a liquid paraffinic solvent (or solvents), and intimately contacted by added asphaltenes in the contacting apparatus 1, which may be a mixer-settler, a fluidized-bed, etc. to effect the preciptation of the asphaltic constituents and the nonhydrocarbon constituents, together with said added asphaltenes. The mixture of solid masses precipitated is then sent to the flashing (or drying) apparatus 2, where the residual volatile constituents (mainly the solvent added in said contacting apparatus) is removed from said mixture, which is treated in the stripper 3 to produce asphalt. The deasphalted oil is separated from the solvent by evaporation in the evaporator 4 and steam-stripped in the stripper 5. The solvent recovered in each of the four steps is combined and recycled to the contacting apparatus 1 as shown. By the method of this invention using an added asphaltene as the solid contactor, there is no need to use liquefied propane, or liquefied butane, to treat feedstocks at high temperatures and high pressures. The treated oil is suited as a feedstock for catalytic cracking and for many other refining operations.

Figure 3:
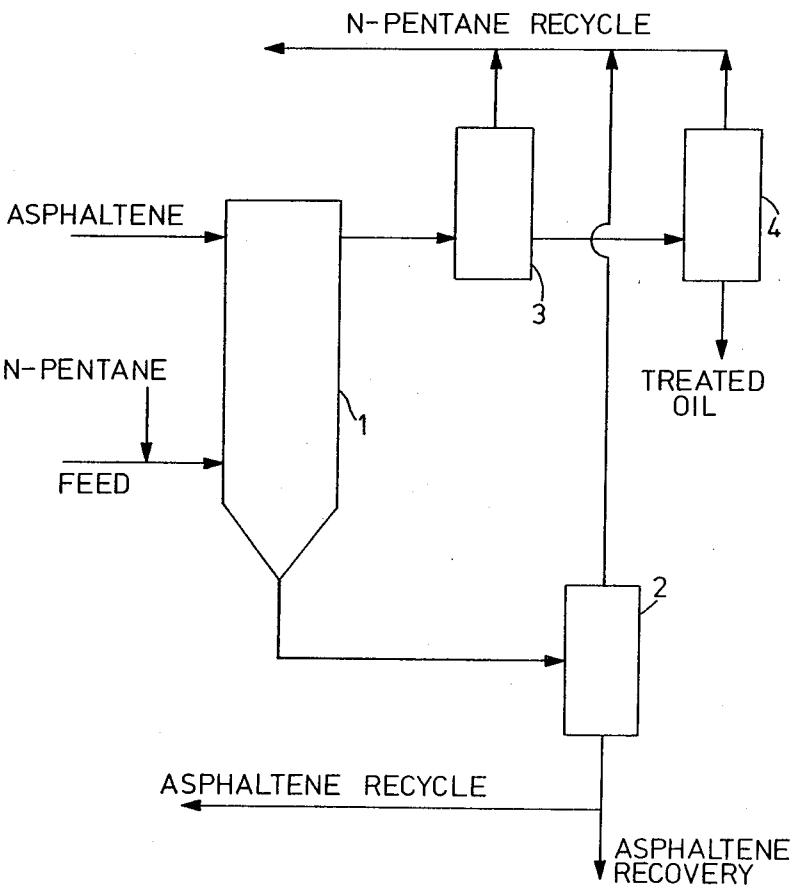
FIG. 3 is a schematic representation of another preferred, basic process for the refining and partially separating heavy crude petroleums, bitumens, residua, etc., together with the recovery of asphaltenes, in accordance with the method provided by the invention.

As noted above, FIG. 3 illustrates another preferred embodiment of the basic process for refining and separating heavy crude petroleums, bituments, residua, etc., in accordance with the method provided by the invention; said process including the recovery of the asphaltenes and the solvent, n-pentane. The process is basically identical to the one shown in FIG. 2, except that n-pentane is used as the solvent in order to precipitate the asphaltenes, and that the treated oil containing resins will not be suited as a feedstock for catalytic cracking, but may be used in thermal cracking. Referring to FIG. 3, the contacting apparatus 1 may be a mixer-settler, a fluidized-bid, etc., in which the feedstock is diluted with n-pentane and then intimately contacted with added asphaltenes to effect the precipitation of the asphaltenes contained and the nonhydrocarbon constituents, together with said added asphaltenes. The total asphaltenes precipitated are then separated from the oil fractions remaining, and then flashed and dried in the flashing apparatus 2 to produce high-quality asphaltenes, which can be recycled or recovered as a by-product. The oil fractions are separated in the evaporator 3 and in the stripper 4 to remove the n-pentane for recycling. The treated oil recovered will contain resins, and is suited as a feedstock for thermal cracking, or for resin recovery. Needless to say, the bottoms from the n-pentane recovery unit 5 in FIG. 1 and/or from the n-pentane recovery unit 5 in FIG. 3 can be treated by a hydrocarbon solvent, preferably liquefied propane, liquefied butane, or isobutane.

As may be obvious from the above discussion, in treating heavy crude petroleums, bitumens, residua, etc. the feedstock should be diluted with a suitable hydrocarbon solvent (or solvents) before the contacting with an added asphaltene. The asphaltenes to be used for the contacting with feedstocks are preferably treated by n-pentane to dissolve the resins, while preserving the original characteristics of said asphaltenes.

The conditions of the contacting operation are very important in achieving the objects of the operation. Several important operational variables are summarized below.

1. Temperature—The temperature of contacting can affect the fluidity of the feedstock, the hydrogen bonding between the asphaltenes and the resins, the rates and the equilibria of the redistribution of various constituents near the asphaltene-resin interface and inside the asphaltene-resins micelles. The temperature in the contacting apparatus is normally maintained above 60° F., but not exceeding the boiling point of the feedstock (or diluted feedstock). It has been found adequate to heat crude petroleums at approximately 160° F. for 10 to 30 minutes, and then cool it to room temperature, at which the precipitation of the asphaltic constituents takes place more readily. The agglomeration of fine precipitates is facilitated by gentle agitation for a period of several minutes before the solid-liquid separation (filtration) may be attempted.

2. Pressure—When no liquefield gas solvent is employed the pressure will have no effect. The method provided by the invention prefers a liquid hydrocarbon solvent for diluting feedstock as may be needed; and the contacting is normally carried out at atmospheric pressure.

3. Contacting time—The contacting time needed depends on the nature of feedstock, the contacting temperature, the dilution ratio, the amount of asphaltenes added relative to the amount of the asphaltic constituents in the feedstock. Heavier feedstocks, lower contacting temperatures, lower dilution ratios, and small amounts of asphaltenes added normally would require longer contacting time. The method and apparatus of contacting also will affect the contacting time required, as may be obvious.

4. Agitation—The intimate and uniform contacting between the feedstock and the added asphaltenes can be achieved rapidly at a higher temperature, if isotropic turbulenece is obtained. Once the asphaltene particles and the resin particles have achieved the intimate contacting, little or no agitation is required for the precipitation of the asphaltic constituents. To facilitate the agglomeration of all the precipitates, gentle agitation is useful. The above suggests that a combination of a slurry-pump, a solid-state mixer, and a vertically elongated, multi-stages tank equiped with a slow stirrer would be an ideal contacting apparatus. The feedstock, the solvent (if used), and the asphaltenes are fed together to the slurry pump which pumps the slurry formed through a solid-state mixer to achieve the uniform, intimate contacting between the three before entering said tank, where the precipitation and the agglomeration can take place.

5. Slip velocity—If a packed-bed or a filter-bed of asphaltenes is used, slower slip velocities and longer residence time are important in order to effect the precipitation, the agglomeration, and the separation of the asphaltic constituents while the feedstock flows through said bed.

6. Viscosity—The viscosity of the feedstock should be adjusted by heating or dilution with a petroleum fraction (or fractions) to facilitate the intimate contacting between the asphaltenes and the resins and the precipitation of the asphaltic constituents. For ordinary crude petroleums, the dilution would not be required if the contacting is carried out at its boiling point, or about 160° F.

7. Asphaltenes—As noted above the type and the cleanness (free from resins and other heavy aromatics) of the asphaltenes to be used for the contacting operation are extremely important. Preferably, they are identical, in type, to those contained in the feedstock, or similar types having high aromaticity and low H/C ratio, and have been treated by n-pentane, for the reasons already described above. The n-pentane precipitated asphaltenes are reasonably free from resins and other heavy aromatics, and extremely effective as the solid contactor to be used in the method provided by the invention. The amount of asphaltenes required depends mostly on the asphaltenes-resins solvation constant of the feedstock, as already discussed above. The asphaltenes-resins solvation constant (or ratio) normally decreases as more paraffinic solvent is added to the feedstock. While the solvent molecules dissolve the resin molecules and attempt to remove them away from the peptized asphaltene molecule, the effect of an added asphaltene is to use the molecules of the added asphaltenes to make hydrogen bonding with these resin molecules and to break the existing hydrogen bonds that they make with the peptized asphaltene molecule. It is important to note that the asphaltenes to be used for contacting should *not* be treated by a solvent which can dissolve said asphaltenes, or change their characteristics, especially their surface properties and chemical structure. For example, cycloparaffins, aromatics, cyclohexane, pyridine, nitrobenzene, methylene dichloride, chloroform, carbon disulfide, carbon tetrachloride, etc., which can attack asphaltenes, should not be used in diluting feedstocks or treating asphaltenes. Steam stripping, at a high temperature, of asphaltenes should be done with a great care so that the asphaltenes would not be badly oxidized or changed.

8. Solvent—As already discussed above, hydrocarbon solvents having low aromaticity, low polarity, and high H/C ratio are in general suited for use in diluting feedstocks. Although low molecular weight paraffinic solvents are preferred, in most cases a petroleum fraction (or fractions) containing little or no aromatics and having a boiling range below 400° F. is adequate as a diluent for most feedstocks. Petroleum fractions having a boiling range as high as nearly 600° F. may also be used if they are mixed with fractions having low boiling ranges, and if the contacting is carried out at a temperature above 160° F.

There are a wide variety of solid-liquid separation methods and apparatus, which can be applied to the solid-liquid separation operation following the contacting operation in accordance with the method of the invention. A few examples are: filtration (both batch and continuous), centrifugation, liquid cyclone, settling, etc. The conditions for the separation will depend on the nature of the feedstock and of the precipitates to be separated. Filtration and centrifugation are usually very effective; liquid cyclone is not as effective; and simple settling is too inefficient if the feedstock is not diluted considerably.

Thus, the simple method provided by the invention can simultaneously remove the asphaltic, metalic, and heteroatomic constituents rapidly from petroleums and/or related materials. It may include the recovery of asphalts and of asphaltenes, without any operational difficulties. The method can be modified through the use of various additives, if desirable, thus enhancing its effects and broadening its applicability. For example, various solid sorbents, such as inorganic metalic oxides (silica gel, alumina, zeolite, etc.), clay minerals, fullers earth, molecular seives, etc. and organic solid sorbents, such as activated carbons, charcoals, lignite coals, etc. can be used together with asphaltenes, if desirable, as the contactors. In the solid-liquid separation operation, filter-aids such as diatomaceous earth, gypsum, etc. can be used to facilitate the filtration of the precipitated asphaltic constituents. Polyvalent electrolytes which promote the precipitation, metalic halides which react with heavy aromatics to form halides of the aromatics for easier separation of resins and asphaltenes, or acids which react with asphaltenes and precipitate same from petroleums also can be considered as additives. It should be kept in mind that any foreign substances introduced to a feedstock could become a source of the contamination of the treated oils and of the products of the subsequent refining processes. Furthermore, the complete separation of these additives from the solid hydrocarbon constituents (asphaltenes and resins) is usually extremely difficult and costly. Therefore, the use of nonhydrocarbon substances is not preferred in the method provided by the invention.

The method of this invention may also be carried out in conjunction with the conventional method, or methods, in order to complement said conventional method. However, for the reason described above, this approach must be considered carefully in order to avoid the possible operational difficulties and the contamination problems.

In order to illustrate specifically the practice and the benefits of the present invention, the methods described in detail in connection with the accompanying FIGS. 1 through 3 were followed in numerous experimental runs conducted. The results of some typical experimental runs are shown in TABLES 1 and 2; the former reporting the results of experiments involving the treatment of eleven (11) different crude petroleums; and the latter reporting the results of experiments involving the treatment of four (4) different residua.

Referring to TABLE 1, for each crude oil treated and for each property measured, the first value listed is that obtained before the treatment and the second value listed is that obtained after the treatment. The properties determined are: the specific gravity at 60° F., the sulfur content by weight percent (%), the nitrogen content by weight percent (%), the atmospheric residue at cut point of 700° F., and the asphaltenes recovered by weight percent (%). Because of the inevitable loss of asphaltenes during the recovering process conducted in the laboratory, the percent of the asphaltenes recovered reported in TABLE 1 is smaller than the true value, and the reproducibility of the data is probably about ±10%. In carrying out each run, the crude in the amount of 2000 milliliters was added with the n-pentane precipitated asphaltenes (previously recovered from the same crude stock) in the amount equal to one half (½) of its atmospheric residue (cut point: 700° F.), and then boiled at about 160° F. for approximately 10 minutes. The slurry was then allowed to cool to room temperature (about 70° F.) prior to the filtration of said slurry through No. 4 Whatman filter paper to separate the entire precipitates. Said precipitates separated were then treated with n-pentane (10 volumes) to precipitate only the asphaltenes, which were dried in vacuum at about 190° F. prior to the weighing. The net amount of the asphaltenes produced, which is the difference between the total asphaltenes recovered and the asphaltenes added, was converted to weight percent and reported in TABLE 1. Control runs were made for each crude oil without adding the asphaltenes, by following the same procedure. No. asphaltenes could be separated in all of the control runs made.

As may be seen in TABLE 1, the contacting of these crude oils with the added asphaltenes has resulted in the reduction in specific gravity as much as nearly 6 percent (%), in sulfur content over 80 percent (%), in nitrogen content over 80 percent (%), in ash content over 85 percent (%), and in residue content nearly 95 percent (%).

TABLE 1

| | Treatment of Various Crude Petroleums | | | | | |
|---|---|---|---|---|---|---|
| Crudes | Specific Gravity (—) | Sulfur Content (Wt. %) | Nitrogen Content (Wt. %) | Ash Content (Wt. %) | Residue Content (Wt. %) | Asphaltenes Recovered (Wt. %) |
| California | 0.895 | 0.51 | 0.398 | 0.0009 | 33.8 | 0 |
| K | 0.856 | 0.08 | 0.071 | 0.0001 | 1.4 | 20.6 |
| California | 0.910 | 1.84 | 0.555 | 0.0035 | 41.9 | 0 |
| L.A. | 0.859 | 0.31 | 0.104 | 0.0004 | 2.8 | 29.1 |
| Colorado | 0.850 | 0.56 | 0.073 | 0.0004 | 26.5 | 0 |
| R.B. | | 0 | | | | |
| | 0.838 | 0.12 | 0.012 | 0.0000 | 1.2 | 17.5 |
| Illinois | 0.847 | 0.21 | 0.138 | 0.0005 | 28.3 | 0 |
| L | 0.831 | 0.03 | 0.033 | 0.0000 | 1.6 | 15.0 |
| Kansas | 0.896 | 0.76 | 0.19 | 0.0021 | 43.6 | 0 |
| R | 0.851 | 0.11 | 0.03 | 0.0002 | 2.7 | 27.3 |
| Louisiana | 0.846 | 0.21 | 0.040 | 0.0008 | 20.6 | 0 |
| L | 0.830 | 0.02 | 0.000 | 0.0000 | 1.1 | 11.2 |
| Oklahoma | 0.928 | 1.68 | 0.482 | 0.0022 | 55.9 | 0 |
| G | 0.864 | 0.29 | 0.080 | 0.0003 | 2.6 | 35.5 |
| Oklahoma | 0.893 | 1.34 | 0.243 | 0.0020 | 48.9 | 0 |
| S | 0.848 | 0.24 | 0.036 | 0.0003 | 3.1 | 30.7 |
| Texas | 0.871 | 0.15 | 0.020 | 0.0003 | 23.0 | 0 |
| B | 0.845 | 0.02 | 0.000 | 0.0000 | 1.3 | 16.4 |
| Texas | 0.863 | 2.12 | 0.00 | 0.0005 | 27.0 | 0 |
| G | 0.841 | 0.36 | 0.000 | 0.0000 | 1.5 | 15.8 |
| North | 0.846 | 0.44 | 0.21 | 0.0001 | 39.9 | 0 |
| Sea | 0.835 | 0.04 | 0.02 | 0.0000 | 2.5 | 17.3 |

The weight of the asphaltenes separated varied 11.2 to 35.5 percent (%), depending on the crude oil treated. These results represent that the separation of asphaltenes is over 95 percent (%) in most cases, considering the fact that the reduction in residure is over 95 percent (%) in most cases.

In TABLE 2, the results of experimental runs involving the treatment of four (4) different still residua from four (4) different crude oils are reported. Except North Sea residue, which was a vacuum still residue with 1070° F. cut point, the other three residua were atmospheric still residua with 700° F. cut point. Each residue was treated in three different ways: (1) contacting with the asphaltenes; (2) contacting with silica gel; and (3) contacting with a mixture of asphaltenes and silica gel. In carrying out each run, the residue in the amount of 200 milliliters was first diluted with 1200 milliliters of aromatic-free gasoline (boiling range: 180° to 400° F.), and then boiled with one of the solid contactors at approximately 160° F. for about 20 minutes. The amounts of the three solid contactors employed were: (1) asphaltenes (60 grams); (2) silica gel (120 grams); and (3) asphaltenes-silica gel mixture in 1:1 ratio (100 grams). After the boiling, the slurry was allowed to cool to room temperature (about 70° F.) and, then filtered through No. 4 Whatman filter paper to separate the entire precipitates. Said precipitates separated were then treated by n-pentane (10 volumes) to precipitate only the asphaltenes, which were dried in vacuum at about 190° F. prior to the weighing. The net amount of the asphaltenes produced, which is the difference between the total weight of the recovered solids and the solid contactor added, was converted to weight percent and reported in Table 2. Control runs were made for each residue without adding a solid contactor, by following the above procedure. No asphaltenes could be separated in all of the control runs made.

TABLE 2

| Recovery of Asphaltenes from Various Residua | | | | |
|---|---|---|---|---|
| | Solid Contactors | | | |
| Residua | Asphaltenes | Silica Gel | Asphaltenes/ Silica Gel | None |
| Texas B | 36.0% | 11.2% | 21.3% | 0% |
| Oklahoma G | 41.2% | 14.3% | 22.5% | 0% |
| North Sea | 73.1% | 20.1% | 41.1% | 0% |
| Monangas | 71.4% | 27.5% | 42.0% | 0% |

The data given in TABLE 2 are the average values obtained from several runs made for each residue. As may be seen from TABLE 2, in every instance the result of contacting by 60 grams of the asphaltenes is better than that by 120 grams of the silica gel or that by 100 grams of the asphaltenes-silica gel mixture. The results indicate also that the ability of the asphaltenes to deasphalt these residua is approximately 5 to 6 times that of the silica gel used. The weight percent (based on the residue) of the asphaltene separated in each case is over 30 percent (%), which may account for the near complete separation of the asphaltenes contained in the residue. It was extremely difficult to separate the asphaltenes precipitated from the silica gel added. Therefore, it is not preferable to mix another solid contactor with the asphaltenes in treating petroleums and/or related materials by the method provided by the invention.

In addition to those crude petroleums and residua listed in TABLES 1 and 2, many other crude petroleums, bitumens, and residua have been refined and separated successfully, using various asphaltene doses, solvents, and dilution ratios under various experimental conditions, all in accordance to the method provided by the invention. Other experimental runs have been made, using different methods of solid-liquid contacting and of solid-liquid separation. In all cases, substantially similar beneficial results were obtained.

It is obvious from the above illustrations and discussion that petroleums and/or releated materials can be refined by removing the asphaltic, metalic, and heteroatomic constituents, by contacting same with added asphaltenes to effect the precipitation of said constituents, and then separating the resultant precipitates to recover the treated oil (and/or gas) containing a substantially reduced concentration of said constituents, in accordance with the method provided by the invention. In carrying out said method, the fluidity of the feedstock to be treated should be adjusted, if necessary, by heating or solvent dilution in order to facilitate the contacting and the precipitation. Said added asphaltenes are preferably the type identical to that contained in the feedstock to be treated, or those having a lower H/C ratio, and substantially free from resins and other heavy aromatics. The optimum dose of said asphaltenes to be added depends mainly on the nature of the feedstock to be treated. The method, apparatus, and operating conditions for said contacting and for said separation of precipitates may vary widely, as already described above in detail. Furthermore, both said contacting and said separation of precipitates can be carried out in a single apparatus, such as a mixer-settler, a filter-bed of asphaltenes, a continuous filter (using asphaltenes as the filter aid), etc., if desirable.

The method provided by the invention may also be carried out in conjunction with one of many conventional methods, if the circumstance permits. Said method may also be modified by the use of various additives intended to affect the efficiency of said method although the possible contamination, by said additives, of the treated streams and the products from the subsequent operations must be carefully considered.

The solvent (or solvents) to be used in diluting heavy feedstocks and in precipitating the asphaltenes to be used for said contacting must be compatible with said feedstocks and asphaltenes. For diluting, a petroleum fraction (or fractions) having a boiling range not exceeding 600° F. is preferable. For precipitating the asphaltenes to be used as the contactor, n-pentane is preferred, for the reason already described above.

It is obvious to those who are skilled in the art that the recycling of the treated oil can be practiced in the method provided by the invention, in order to increase the final separation efficiency. In the alternative, several units of the contacting and solid-liquid separating apparatus can be connected in series and/or parallel, in order to increase the capacity and/or the separation efficiency of the process.

It should be understood that the present invention applies to the refining and separation of all petroleums and all petroleum-related materials and to the recovery of asphalts and/or asphaltenes from said petroleums and/or said materials, by contacting same with added asphaltenes, preferably the type identical to that contained in said petroleums and/or said materials to be treated, or one having lower H/C ratio, to effect the precipitation of the asphaltic, metalic, and heteroatomic constituents, and then separating the resultant precipitates from the treated oil (and/or gas) containing a reduced concentration of said constituents. Therefore, the intimate contacting between the feedstock to be treated and said added asphaltenes, and the complete precipitation and subsequent separation of said constituents precipitated together with said added asphaltenes are the keys to the method provided by this invention.

The invention claimed is:

1. A method for treating a liquid hydrocarbon feedstock containing asphaltenes having resins and heavy aromatic compounds associated therewith to remove said asphaltenes which comprises (A) intimately mixing said feedstock with asphaltenes which are substantially free of resins and heavy aromatic compounds while maintaining said feedstock at a temperature below the boiling point of said feedstock, the amount of said asphaltenes combined with said feedstock being sufficient to break the equilibrum existing between the asphaltenes initially present in said feedstock and the resins and heavy aromatic compounds associated therewith to cause precipitation of substantially all of the asphaltenes initially present in said feedstock and added asphaltenes, (B) separating precipitated asphaltenes from said feedstock by subjecting said feedstock containing added asphaltenes to a mechanical separation, and (C) recovering a liquid hydrocarbon fraction of substantially reduced asphaltenes content.

2. The method of claim 1 in which said asphaltenes added to said feedstock have a high aromaticity and a low ratio of hydrogen to carbon.

3. The method of claim 1 in which said asphaltenes added to said feedstock are those obtained from the same type of feedstock.

4. The method of claim 1 in which the feedstock containing added asphaltenes is maintained at a temperature of about 160° F. for a period of about 10 to 30 minutes then cooled to ambient temperature to precipitate asphaltenes.

5. The method of claim 1 in which a low molecular weight paraffinic hydrocarbon solvent is added to said feedstock prior to addition of asphaltenes.

6. The method of claim 5 in which said solvent comprises n-pentane.

7. The method of claim 1 in which said precipitated asphaltenes are treated with n-pentane to remove resins and heavy aromatic compounds associated therewith, and at least a portion of said thus treated asphaltenes are recycled and combined with new feedstock.

8. The method of claim 1 in which said feedstock comprises a heavy crude petroluem.

9. The method of claim 1 in which said feedstock comprises a residuum from a heavy crude petroluem.

10. The method of claim 1 in which said feedstock comprises the approximately 600° F. cut point residue of a heavy crude petroleum, and the amount of asphaltenes added to the feedstock is about one half the amount of the feedstock.

11. A method for treating a liquid feedstock comprising a heavy crude oil or residuum thereof containing asphaltic constituents including asphaltenes having resins and heavy aromatic hydrocarbons associated therewith to remove said asphaltic constituents from said feedstock which comprises (A) initimately mixing said feedstock with asphaltenes which are substantially free of resins and heavy aromatic hydrocarbons usually associated therewith in an amount sufficient to break the equilibrium existing among said asphaltic constituents and precipitate said asphaltic constituents whereby said precipitated asphaltic constituents form agglomerates with said added asphaltenes, on the order of at least about 95% of the asphaltenes initially present in said feedstock being thereby precipitated;

(B) subjecting said feedstock containing added asphaltenes to a mechanical separation to remove said agglomerates, and (C) recovering a liquid hydrocarbon fraction of reduced asphaltic content.

12. The method of claim 11 in which said asphaltenes added to said feedstock have a high aromaticity and a low ratio of hydrogen to carbon.

13. The method of claim 11 in which said asphaltenes added to said feedstock are those obtained from the same type of feedstock.

14. The method of claim 11 in which the feedstock containing added asphaltenes is maintained at a temperature of about 160° F. for a period of about 10 to 30 minutes and then cooled to ambient temperature to precipitate asphaltenes.

15. The method of claim 11 in which a low molecular weight paraffinic hydrocarbon solvent is added to said feedstock prior to addition of asphaltenes.

16. The method of claim 15 in which said solvent comprises n-pentane.

17. The method of claim 11 in which said precipitated asphaltenes are treated with n-pentane to remove resins and heavy aromatic compounds associated therewith, and at least a portion of said thus treated asphaltenes are recycled and combined with new feedstock.

18. The method of claim 11 in which said asphaltenes added to the feedstock are in an amount of at least about one-half the amount of the approximately 600° F. cut point residue of the feedstock.

* * * * *